United States Patent [19]

Stelben

[11] 4,289,395

[45] Sep. 15, 1981

[54] COPY SHEET DEFLECTOR FOR AN ELECTROPHOTOGRAPHIC COPIER

[75] Inventor: John J. Stelben, Greenwich, Conn.

[73] Assignee: Pitney Bowes, Inc., Stamford, Conn.

[21] Appl. No.: 108,085

[22] Filed: Dec. 28, 1979

[51] Int. Cl.[3] ..... G03G 15/00

[52] U.S. Cl. ..... 355/3 BE; 355/16

[58] Field of Search ..... 355/3 BE, 16, 3 R, 3 TR, 355/3 SH

[56] References Cited

U.S. PATENT DOCUMENTS

| | | | |
|---|---|---|---|
| 3,697,171 | 10/1972 | Sullivan | 355/3 R |
| 4,035,750 | 7/1977 | Staudenmayer | 355/3 R |
| 4,088,403 | 5/1978 | Kingsley | 355/3 BE |
| 4,183,652 | 1/1980 | Yanagawa | 355/16 |
| 4,231,653 | 11/1980 | Nagahara | 355/3 FU |

*Primary Examiner*—Richard L. Moses

*Attorney, Agent, or Firm*—Lawrence E. Sklar; William D. Soltow, Jr.; Albert W. Scribner

[57] ABSTRACT

An electrophotographic copier, which incorporates an endless web style photoconductor, has a copy sheet deflector strategically mounted above the detaching web idler roller, and over the prescribed path of travel leading to the fixing station. The sheet deflector provides a means of protection for the copier instrumentalities otherwise damaged by those copy sheets unaccepted to the fixing station due to irregular shape, or mishandling during transport leading to the fixing station.

3 Claims, 3 Drawing Figures

COPY SHEET DEFLECTOR FOR AN ELECTROPHOTOGRAPHIC COPIER

FIELD OF THE INVENTION

Recent improvements in compact office copier equipment have resulted in the development of cold pressure fixing devices to provide permanently fused copy. To date, office copier equipment has been predominantly equipped with different variations in fuser design which utilize radiant thermal energy. One particular thermal fuser design uses radiant lamp energy which is focally concentrated on the toner laden copy sheets being transported through the fuser unit on belts. Several elongated radiant lamps are positioned within separate highly finished reflectors which concentrate the radiant energy into narrow lateral energy beams with temperatures approaching 400° F. The intense energy beams provide sufficient temperature to easily soften the toner and subsequently cause the toner image form to flow into the fibers of the copy sheet where the toner becomes permanently attached upon cooling.

Yet another variation of a thermal fuser employs a pair of hollow aluminum cylinders, one of which has included an internal, fixed resistance type heater. When turned on by automatic signaling means, the heater provides rapid thermal energy to the cylinders' outermost surface. The combination of heat and pressure is then applied to the unfused copy sheet at the roll nip. Both cylinders are covered with a thin layer of heat resistant silicone elastomer, and through additional auxiliary application apparatus, a silicone oil in minute amount is applied as a coating to the outside surface of the toner contacting pressure cylinder. The silicone oil aids as a release agent which ensures that the processed copy sheet does not stick to the pressure rollers.

Beyond the prior fusing art, and in view of continuing present interest in energy conversation and respective cost of materials, the application and use of cold pressure fusers in office copiers is very attractive. The simple principles in design of the cold pressure fuser, provides a substantial degree of uniformly distributed pressure to the toner lying image form upon the copy sheet. In addition, the two relatively large diameter steel pressure rollers provide a transport vehicle in order to facilitate sheet delivery to the operator at the exit tray. Mechanical loading is applied to the steel pressure rollers at their respective end journals with the use of large compression springs, conveniently mounted on the roller support arms. A compression spring pushes on an pivoting support arm, further supported by another structural arm member, which is secured to the copier framework at both ends of the fuser apparatus. In this manner, the combination of pivoting roller support arms, operates in a principle not unlike a nutcracker, providing mechanical advantage by the principles of levers in order to exert magnified compression spring force to the end journals of one roller of the cold roller pair.

In addition, both rollers are intentionally slightly inclined with respect to each other by virtue of the journal locations within the suspension and structural support arms. The inclination allows the two cold rollers to cross each other respectfully center span. The net result of this particular arrangement results in uniform distributed pressure across the entire cold roller nip, suitable for pressure fixing purposes.

The nature of such a device employing crossed steel rollers is described in detail within U.S. Pat. No. 2,762,295 to Vargas. In that patent, the particular benefits, mechanisms and advantages involved in bending steel rollers in order to achieve uniform nip pressure for process requirements are described in great detail.

It must be recognized that the nip pressure generated between the cold fuser rollers is quite substantial in magnitude. A typical cold pressure fuser system will have a total load applied of nearly 3,000 pounds which, when applied to a roller 10 inches in length, equates to 300 pounds per lineal inch in terms of distributed load. Within the typical office copier, however, 9 inch rollers are suitable in length to cover the standard widths of copy sheet paper. However, there have been cold fuser assemblies built with 15 inch long rollers to cover legal paper sizes fed in a widthwise direction.

In spite of the magnified pressures, and irrespective of lineal paper velocity, the steel pressure rollers are not adversely effected by rolling on themselves, or by being subjected to a constant stream of copy sheet paper with unfused toned images. Both cold rolls are appropriately case hardened and ground to a fine microfinish, which is designed for withstanding wear and for providing the best contact relationship with the copy sheet. Also, the resilient compression spring loading system applied to the rollers at each respective support arm enables the cold roll system to yield and accommodate varying copy sheet thicknesses, especially those in good physical condition.

Of course, another beneficial aspect of using a cold pressure fuser lies in the fact that it does not consume any energy during copier machine idle modes. This is quite unlike either version of the thermal fuser design previously described where it is necessary to maintain precise elevated temperatures in order to provide reasonable completed copy delivery time. Actually, the cold pressure fuser provides an instant on service for the operator, which is difficult, if not impossible, to achieve with the thermal fuser arrangements.

While cold pressure fixing has distinct attractive advantages over thermal means, especially when design simplicity and energy consumption is considered, the cold system is sensitive to physical copy sheet condition. Also, copy sheets in transit along the prescribed path of travel from the process stages of the copier to the fixing unit require greater physical positional accuracy, in respect to alignment with the cold roller nip. In fact, it is quite essential to ensure precise sheet alignment with the cold roller nip in all respective physical directions to insure acceptance into the fixing system. The lead edge of the sheet should be aimed at the roller nip as accurately as possible while the remainder of the sheet should be maintained parallel to the overall machine optic and paper flow paths. Also, the sheet's lead edge should be kept as flat as possible to avoid wrinkles or bumps which would otherwise strike the cold rollers in a peripheral portion at some distance from the nip and out of the designed path of travel. The consequence of misalignment of the sheet with the roller nip will result in a likely jam, or more than likely the sheet will not be accepted to the nip at all.

Therefore, any damage that inadvertantly occurs to the copy sheet supplies, or to an individual copy sheet during feeding, or transport to the fixing station, increases the probability of non-acceptance to a cold roller pressure nip. To avoid this possibility, it is imperative for the copier machine operator to carefully handle the copy sheet supplies. It is also essential from a design standpoint to provide transport guides for the individual copy sheet being processed, that exercise directional control without causing undue damage to the sheet. If, for instance, the copy supplies are damaged in the course of either operator handling, or automatic transport handling, and the paper assumes dog ears, wrinkles, creases, tears, or excessive moisture, any one condition or combination of conditions will strongly increase the probability of unacceptance at the cold roller nip.

In addition, since the inherent design of the cold roller fuser apparatus provided large magnitude pressures at the nip, it would be expected that there is a substantial roller separation force required when the copy sheet lead edge is presented to the roller nip. In fact, the separation force is so substantial that a momentary shock occurs at the instant of entry of a copy sheet. This shock immediately results in a peak torque load which translates to the connecting fuser roller drive system. At this point, it will be recognized that those copy sheets in any sort of poor physical condition due to mishandling, misdirection or abuse will have difficulty in being accepted into a cold pressure roller system. It is also noted that these same sheets do not necessarily have an alternate, specific path other than the prescribed path of travel, to follow in the event they are not accepted to the cold nip.

Since damaged copy sheets are not always reliably accepted to a cold roller fixing system, they do not flow in the prescribed path of travel of the copier, and further do not arrive where expected at the copy output station. Of course, the machine operator becomes keenly aware of this situation since no output copy is delivered. Likely enough, there is also appreciable noise assoicated with the copy sheets not accepted to the fuser, which will attract operator attention. In consideration of jammed sheets and while the typical office copier is provided with jam sensing devices intended to signal the operator of sheet paper flow problems, a single piece of copy paper can easily travel, in a relatively short period of time, to areas of the machine out of the prescribed path of travel, where the sheet is neither suited nor intended. Even within those office copiers provided with jam sensors and automatic shutdown devices, a sheet can easily cause damage to delicate copier components, prior to shutdown of the paper transport systems. This is especially so within the copier provided with a web style photoconductor upon which a misguided or physically abused copy sheet, intended and directed towards fixing at the fuser station, becomes misguided by simply following the photoconductor web backwards in its respective endless arcuate path.

The final result of having misguided copy sheets out of control of intended transport apparatus or guide means becomes pronounced when one single sheet becomes lodged in one of a number of various sensitive process instrumentalities, for instance the corona charger. For example, within the corona apparatus, delicate wires are strung under tension within the corona shell, and a piece of sheet paper easily becomes entangled or raveled within the shell. Or, a sheet can also travel towards the magnetic toner apparatus, and easily will wrap about the magnetic brush applicator roller. In either case, it becomes extremely difficult for the machine operator to clear the jammed sheet from these mechanisms without causing damage, or at the least an expensive service call in order to properly relieve the jam.

In order to overcome these potential costly and aggrevating copy sheet jam situations, the present invention provides a means of protection through the use of a sheet deflector to increase the reliability of office copiers utilizing pressure roller, fixing means. This, and other benefits of the present invention will become apparent in the following detailed specification.

SUMMARY OF THE INVENTION

The present invention is comprised of a copy sheet deflector which presents a protective deflector shield means for preventing improperly handled, physically damaged or misguided, toned copy sheets from causing damage to the instrumentalities of an office copier machine. The copy sheet deflector is located to advantage at the output end of the transport portion of the photoreceptor web process station, adjacent to the prescribed path of travel for copy sheets, so that is will deflect the trailing end of the copy sheets not accepted to the nip of the cold pressure fixing station before those sheets can become electrostatically attached to the photoreceptor web and travel backwards along with the photoreceptor web in its arcuate path.

OBJECTS OF THE INVENTION

It is an object of the present invention to provide a protective copy sheet deflector in order to prevent damage caused to instrumentalities of a copier machine by inadvertantly misguided sheets that are otherwise unacceptable for processing in the copier fixing unit.

PRIOR ART

In U.S. Pat. No. 4,073,585 the invention discloses apparatus for actuating the copy sheet feed rollers in a reversing direction in order to clear a copy sheet that has failed to strip from the photosensitive body. Signal detection means associated with the sheet trailing edge activates the clearing mode.

DETAILED DESCRIPTION

Figure 1:
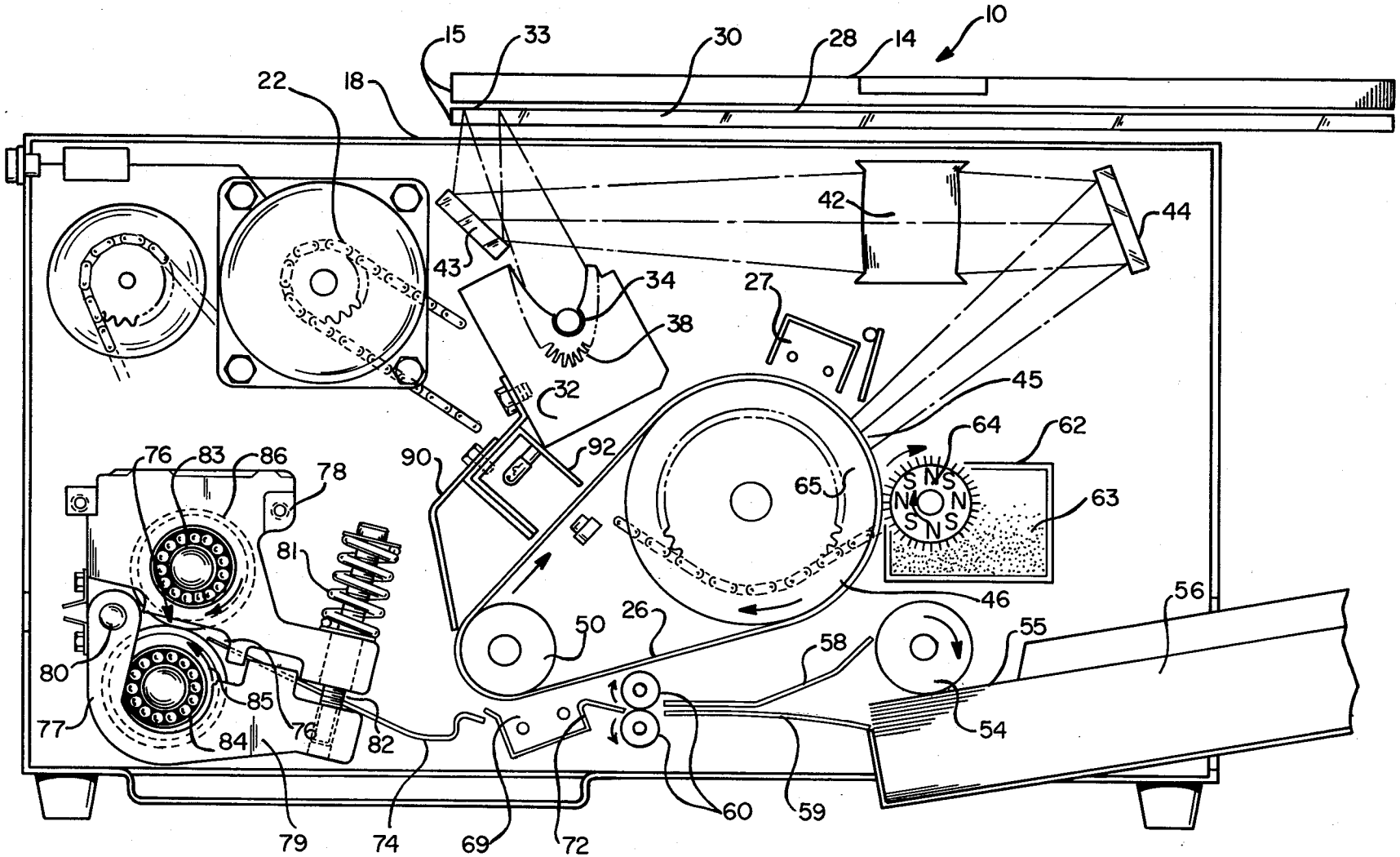
FIG. 1 represents a longitudinal view of an electrophotographic office copier employing external scanning, a photoconductor web apparatus, and cold pressure fixing means.

For the purposes of description, FIG. 1 illustrates an electrophotographic machine 10 representative of an external scanning desk top office copier. The copier is provided with a book scanning arrangement 14 in which the reciprocating carriage assembly 15 is suspended on top of the machine framework 18 by means of drawer slides, not shown.

Further connecting power transmission means associated with the main copier device system, generally depicted as 22, provides reciprocating motion for carriage assembly 15. Carriage 15 in turn moves in synchronism with a photoconductor web 26 during machine copy cycles. To initiate a given machine copy cycle, there is also provided an externally accessible operator control panel. The control panel and external mounting cover are not shown but understood to be operator accessible while the external machine covers generally provide protection to the operator from internal, moving or rotating machine elements.

When a machine operator depresses the "print" button located on the control panel, the copy cycle begins. The copier machine starts from an idle position in which no internal mechanism is moving but electrical power is available. Actuation of the "print" button basically provides an electrical signal to begin sequential xerographic copier process functions well known to those skilled in the art.

Prior to actuation of "print", an original document 28 is intentionally placed facing down on the carriage assembly glass 30. When the machine cycle beings, a statonary illumination system 32, appropriately fastened to framework 18 and comprised of lamp 34 and reflector 38, provides focused light on the original document for the purposes of image projection.

While the illuminated original document carried upon carriage glass 30 is transported past the fixed illumination system 32, the original image is correspondingly illuminated at 33 and translated through optical lens system 42. There are also cooperating reflective mirrors 43 and 44 which are placed in the optical translation path for the purpose of bending the translated image in an arrangement intended for compactness. Eventual presentation of the illuminated original image 33 occurs in an image reception zone 45 where a charged photoconductor web 26, driven in exact synchronization with the carriage apparatus 15, receives the projected image in entirety. The net resulting image is carried forward to the development apparatus 62 in latent form having been exposed in film fashion and suitably prepared for subsequent development. While the latent image on the photoconductor web appears inverted at development, subsequent transfer of the image into a suitable copy sheet inverts the image into its correct readible form.

It is understood by those skilled in the art that the photoconductor charger apparatus 27 creates a charge potential necessary at exposure of the photoconductor web 26 in order to receive the projected original image 33. Also, it will be understood that the photoconductor web 26 and all surrounding process system instrumentalities are appropriately supported in the copier framework 18 with the use of standard fastening hardware, and suitable bearing journals. Rotation for system members such as the photoconductor web 26 is gained through connective drive means associated with the main machine power transmission 22 and all connecting elements provided for that purpose. Web 26, for instance, is frictionally driven by supporting drum 46, while also being tensioned by idler roller 50.

While the scanning carriage apparatus 15 is driven in synchronization with photoreceptor web 26, a pair of copy sheet feed rollers 54 are, in precise timely manner, rotatably actuated through a connected magnetic clutch, not shown. Feed rollers 54 cause a single piece of copy paper 55 to be fed from the supply tray 56 for each carriage cycle, in order to match the number of copies required by the machine operator, and as demanded at the control panel. The rotation of feed rollers 54 pushes a single copy sheet 55 so that it is physically guided between the prescribed path of travel paper guide members 58 and 59. Sheet guide members 58 and 59 lead the sheet directly to the nip of a pair of sheet registration gate rollers 60.

Again, in a appropriate time of the machine cycle, the registration gate rollers 60 are further caused to rotate by a magnetic clutch device, not shown. Timing, being such that the lead edge of the sheet 55 is caused to exactly match the toned image carried upon the moving photoreceptor web 26. As a result, the copy sheet 55 meets the toned image precisely at the leading edge for the purposes of creating a duplicate original document in its entirety and precisely for its length.

It will also be recognized by those skilled in the art, that the previously projected image is developed by means associated with the dry developing unit 62. There is provided a toner developing unit 62 with a reservoir supply of dry particulate marker 63 and an appropriate magnetic applicator brush 64. Marker 63 is triboelectrically charged in the brush unit 62 during motion created by the rotating magnetic brush 64 so that the marker 63 has a charge potential capable of being attracted to the web 26 latent images previously exposed. The applicator brush 64 provides a continuous supply of suitably charged marker 63 during repeated machine cycle running according to the amount of required copies programmed by an operator of the machine at the control panel.

Transfer of the toned latent image to the copy sheet is completed at transfer zone 69 where the image is caused to physically migrate unto the sheet by electrical influence of the transfer charging corona assembly 72. During transfer, and transport, the copy sheet is attracted to the moving web 26 by electrostatic forces, so that no relative motion occurs between the copy sheet 55 and the web 26.

In the continuing course of events, the copy sheet 55 moves along juxtaposed with web 26, while also being synchronously pushed by rotating registration gate rollers 60. It would seem that the sheet would attempt to follow the web 26 about web idler roller 50 due to the electrostatic attraction, but the relatively small diameter of idler roller 50 and the relative stiffness of the copy sheet 55 provides a natural tendency for separation. Immediately upon separation from the web 26, the lead edge of the copy sheet 55 with included unfused toner image, is guided and pushed unto paper guide member 74 which provides a leading positive prescribed path for the sheet 55 to follow to the fuser roller nip 76.

The construction of the cold pressure fuser apparatus is arranged so that a uniform mechanical pressure is developed along the entire lateral nip of the fuser rollers. In order to accomplish this, the fuser is constructed not unlike a double handed nutcracker with the pressure rollers suspended in the arms. Compression springs and appropriate restraining bolts and washers are added to the roller holding arms at both ends so that a degree of yieldability is provided to accept limited thickness variations, of copy sheet material.

Specifically, there is provided a fuser 77 with a frame 78 and suitable mechanical attachments in order to fasten the upper portion of the fuser assembly to the lateral side portions of the copier machine framework 18. In addition, separate roller support arms 79 pivot at a fulcrum pin 80 under influence of separate compression springs 81 which are essentially also resiliently secured to the frame portion 78 of the fuser 77 by means of a bolt 82 which is threaded into support arm 79 at each end of fuser 77. It will be appreciated that the springs 81 allows a yield to occur once a sheet of copy paper 55 enters the roll nip 76, while the springs 81 also provide substantial force to each roller arm 79 with mechanical advantage corresponding to the principles of levers and in respect to fulcrum pin 80.

The bearing journals 83 and 84 are purposely not arranged at right angles with respect to the copy sheet path through the nip created by cold rollers 85 and 86. In other words, the vertical line of centers between rollers 85 and 86 is not normal to the sheet paper path. When the cold rollers are viewed from an overlying position, the rollers 85 and 86 are observed to cross each other at center span creating an included angle of 1°, as a result of the respective journal locations of the rollers. The arrangement thus provided, where the rollers 85 and 86 are crossed, provides an ability for the springs 81 to actually cause the rollers 85 and 86 to laterally bend around each other. The net result of uniform pressure is therefore provided by the crossed roller arrangement across the entire sheet width.

The copy sheet 55 in its intended flat form, and removed from the manufacturers package is considered to be in good physical shape. A sheet in normal flat form is not difficult to guide and transport through the copier machine workings, and in fact enters the cold pressure fuser roller nip quite efficiently, in spite of the high mechanical pressures involved between the cold rollers. It is important to recognize, however, that the lead edge of any copy sheet presented to the cold pressure roller nip 76 should be in relatively good physical shape in order to ensure that the sheet will be accepted.

It is also important to recognize that the distance between the cold pressure roller nip 76 and the idler roller 50 is intended to be less than the shortest length copy sheet to be fed through the copier machine 10 described herein. There is a distinct advantage in providing this reduced distance arrangement from the transfer zone to the fusing station since the overall size of the copier is minimized and more important, maintains positive linear velocity control over the sheets fed through the prescribed path of travel and under control of the belt 26 transporting and sheet transporting rollers 60 described herein.

Referring back to FIG. 1., the copy sheet deflector 90 is shown attached to hardward associated with the photoreceptor pre-clean lamp apparatus 92. In the normal course of events in running the copier machine, the development process includes provision for cleaning the photoconductor web 26 prior to recharging for subsequent copies through use of means associated with pre-cleaning lamp apparatus 92. Since the hardware holding the cleaner apparatus 92 is suitably fastened to the copier framework 18, the copy sheet deflector 90 is easily accommodated mechanically through fastening screws applied for clamping purposes.

Figure 2:
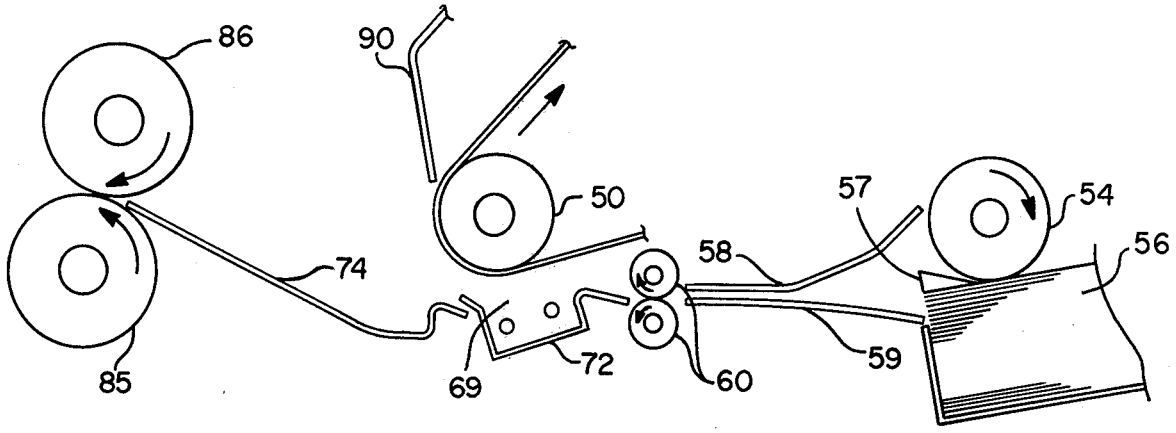
FIG. 2 represents a reduced, fragmentary view of the copier depicted in FIG. 1, and illustrates the copy paper supply with a slightly dog-eared sheet at the feed position.
Figure 3:
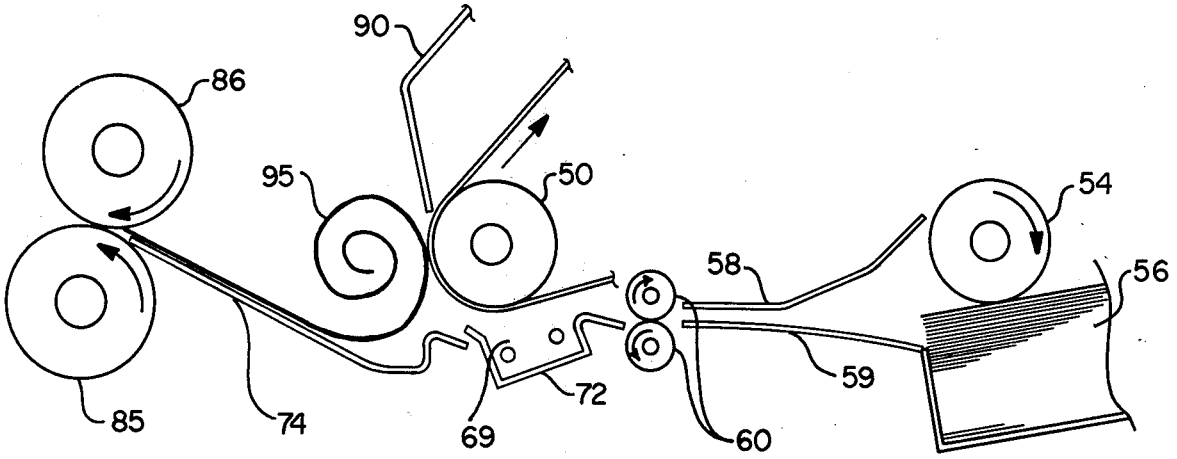
FIG. 3 represents the same fragmentary view of FIG. 2, with the dog-eared sheet jammed at the fixing roller nip.

Referring to FIGS. 1, 2 and 3, it will be noted that deflector member 90 is arranged particularily close to web 26, and in close proximetry to web 26, over and abov idler roller 50. This physical position of deflector member 90 has been provided to eliminate the possibility of the trailing edge 95 of sheet 55 shown in FIG. 3, from being carried backwards along with the normal path of travel of web 26.

It will also be seen in FIG. 2, that the cause of such a situation would result from a copy sheet condition typical and illustrated by dog ear 57, an unintentional and likely occurence when loading copy paper 56 into the copier 10.

FIG. 3 further illustrates the dog ear 57, part of sheet 55, jammed at fuser roll nip 76 and the resulting unrumpled effect on sheet 55, especially at the trailing end 95 shown deflected away from the deflector member 90.

It has been found in the particular copier arrangement shown that the deflector 90 is best fastened in the manner illustrated in FIG. 1, however, it will be recognized that the location, material and fastening techniques may be altered in any suitable manner in order to provide the protection intended.

Therefore, it is intended that the invention described herein be provided to demonstrate improved reliability of office copier machines while eliminating some of the uncertainty of the whereabouts of uncooperative copy sheets not accepted to a copier fusing station. The scope and spirit of the following claims are intended to further capture the merits of the invention at hand.

What is claimed is:

1. In a photocopy machine having operating instrumentalities for reproducing an original document onto a copy sheet and having a prescribed path of travel therethrough for the copy sheet, the combination therewith of apparatus for feeding and guiding the copy sheet along the path of travel and for preventing the copy sheet from being diverted from the path of travel and becoming entangled in the operating instrumentalities, said apparatus comprising:

A. a web of photoconductive material,

B. means supporting a portion of said web such that said portion is disposed in and moves along the path of travel of a copy sheet, at least a part of said supporting means comprising a roller (1) around which the web passes for a portion of its circumference sufficient for the web to effect at least a partial reversal of its direction of movement around said roller, and (2) which has a sufficiently small diameter such that a copy sheet in contact with the web will not normally follow the web around said roller, C. a pair of rotating rollers disposed in the path of travel of the copy sheet and between which the copy sheet is intended to pass, said rollers being spaced from said supporting roller by a distance less than the length of a copy sheet, D. guide means disposed between said supporting roller and said pair of rollers for guiding the leading edge of a copy sheet toward the nip of said pair of rollers, and E. deflector means disposed adjacent said supporting roller and in juxtaposition with the portion thereof where said partial reversal of the web direction of movement is effected, said deflector means being sufficiently close to the web surface to prevent the trailing edge of the copy sheet from following the web along the reverse direction thereof in the event that the leading edge of the copy sheet does not pass through said pair of rollers, whereby the copy sheet rumples in front of said deflector means on said guide means and does not become entangled in the operating instrumentalities of the photocopy machine.

2. The invention as set forth in claim 1 wherein said deflector means composes a flat plate member having a mounting portion by which the plate member is mounted to a portion of the photocopy machine and a deflecting portion which is disposed at an angle to the plane of the web where the web effects said partial reversal of its direction of movement said angle being sufficiently great to cause a copy sheet to rumple against said deflecting portion of said plate member.

3. The invention as set forth in claim 2 wherein said deflecting portion of said plate member terminates at a point adjacent the end of said portion of the supporting roller circumference around which the web passes so as to effectively prevent the trailing edge of a copy sheet from following the web if the leading edge thereof does not enter the nip of said pair of rollers.

* * * * *